US012292248B1

(12) United States Patent
Tanaka et al.

(10) Patent No.: US 12,292,248 B1
(45) Date of Patent: May 6, 2025

(54) BIOMETRIC FIREARM CHAMBER LOCK

(71) Applicant: CASTLELOCK CORPORATION, San Luis Obispo, CA (US)

(72) Inventors: Shaun Tanaka, San Luis Obispo, CA (US); Thomas J. Mackin, San Luis Obispo, CA (US); Ricardo Tan, San Luis Obispo, CA (US)

(73) Assignee: CASTLELOCK CORPORATION, San Luis Obispo, CA (US)

( * ) Notice: Subject to any disclaimer, the term of this patent is extended or adjusted under 35 U.S.C. 154(b) by 0 days.

(21) Appl. No.: 18/946,669

(22) Filed: Nov. 13, 2024

Related U.S. Application Data

(63) Continuation-in-part of application No. 18/516,316, filed on Nov. 21, 2023.

(51) Int. Cl.
*F41A 17/44* (2006.01)
*F41A 17/06* (2006.01)

(52) U.S. Cl.
CPC ..... *F41A 17/066* (2013.01); *F41A 17/44* (2013.01)

(58) Field of Classification Search
CPC ..... F41A 17/00; F41A 17/06; F41A 17/066; F41A 17/34; F41A 17/42; F41A 17/44
See application file for complete search history.

(56) References Cited

U.S. PATENT DOCUMENTS 3,089,272 A * 5/1963 McKinlay ..... F41A 17/44 42/70.11
3,605,311 A * 9/1971 Hermann ..... F41A 17/44 42/70.11
3,634,963 A * 1/1972 Hermann ..... F41A 17/44 42/70.11
4,266,356 A * 5/1981 Jarvinen Uro T. ..... F41A 17/44 42/70.11
4,619,062 A * 10/1986 Johnson ..... F41A 17/44 42/70.11
4,709,496 A * 12/1987 Johnson ..... F41A 17/44 42/70.11
5,331,759 A * 7/1994 Marceau ..... F41A 17/44 42/70.11
5,621,996 A * 4/1997 Mowl, Jr. ..... F41A 17/063 42/70.07
5,669,252 A * 9/1997 Bentley ..... F41A 17/44 42/70.11
6,308,450 B1 * 10/2001 Ireblad ..... F41A 17/44 42/70.11
6,494,069 B1 * 12/2002 Ireblad ..... F41A 17/44 42/70.11

(Continued)

FOREIGN PATENT DOCUMENTS

WO WO-2016099281 A1 * 6/2016 ..... F41A 17/34

*Primary Examiner* — Joshua E Freeman
(74) *Attorney, Agent, or Firm* — Knowmad Law

(57) ABSTRACT

The biometric firearm chamber lock is a biometric electromechanical locking system integrated firearm safety device. The device safely locks firearms by securing the firearm lock into the firearm chamber through the ejection port to prevent rounds from being fired. An electrical biometric sensor quickly unlocks the firearm lock from the firearm. A mechanical backup unlock mechanism is used if a replacement battery is unavailable or if the electrical components fail and cannot be used to unlock the firearm lock. The firearm lock is an independent structure requiring no installation process.

18 Claims, 16 Drawing Sheets

(56) References Cited

U.S. PATENT DOCUMENTS

| | | | | |
|---|---|---|---|---|
| 6,499,244 | B1 * | 12/2002 | Smith | F41A 17/44 42/70.11 |
| 6,591,532 | B1 * | 7/2003 | Gilbertson | F41A 17/42 42/70.11 |
| 10,309,740 | B2 * | 6/2019 | Fishbein | F41A 17/44 |
| 10,422,601 | B2 * | 9/2019 | Harris | F41A 9/65 |
| 10,852,089 | B1 * | 12/2020 | Ramirez Navarrete | F41A 17/066 |
| 11,493,295 | B1 * | 11/2022 | Broadnax | F41C 33/0263 |
| 2004/0035042 | A1 * | 2/2004 | Reed | F41A 17/44 42/70.11 |
| 2005/0229654 | A1 * | 10/2005 | Victor | F41A 17/063 70/58 |
| 2010/0199540 | A1 * | 8/2010 | Bentley | F41A 17/42 42/70.11 |
| 2017/0146309 | A1 * | 5/2017 | Biran | F41A 17/38 |
| 2017/0146310 | A1 * | 5/2017 | Biran | F41A 17/066 |
| 2018/0066910 | A1 * | 3/2018 | Biran | F41A 17/46 |
| 2018/0372436 | A1 * | 12/2018 | Biran | F41A 17/38 |
| 2020/0400398 | A1 * | 12/2020 | Dulude | F41A 9/65 |

* cited by examiner

BIOMETRIC FIREARM CHAMBER LOCK

CROSS-REFERENCE TO RELATED DOCUMENTS

This continuation-in-part application claims priority to U.S. patent application Ser. No. 18/516,316 with filing date Nov. 21, 2023 which is hereby incorporated by reference as if fully set forth herein.

COPYRIGHT STATEMENT

All material in this document, including the figures, is subject to copyright protections under the laws of the United States and other countries. The owner has no objection to the reproduction of this document or its disclosure as it appears in official governmental records. All other rights are reserved.

TECHNICAL FIELD

The present invention relates generally to locks, locking mechanisms, biometric locks, firearms, firearm safety, firearm range safety.

BACKGROUND OF THE INVENTION

Firearms have recently become the leading cause of death for children in America. According to a national survey conducted by researchers at Johns Hopkins Bloomberg School of Public Health, more than half of gun owners in the United States do not safely store all of their firearms. A purpose of the invention is therefore to improve the tradeoff between firearm safety and firearm accessibility through an innovative firearm safety device that provides high firearm security while maintaining easy and fast accessibility only for authorized users.

Firearm owners desire the following attributes in a firearm safety device: affordability, security, quick access, transportability, and no installation required. Currently, there are three primary options in the market: cable locks, guns safes, and trigger locks. Cable locks are very inexpensive, but cable locks can be cut relatively easily using household tools which highlights the ineffective security of this firearm safety device. Full-size gun safes can be secure but are commonly too expensive, not easily transportable, and do not provide quick access to the firearm. Lastly, there are trigger locks, which in the case of many rifles does not prevent disassembly of the firearm, allowing for either easier forced removal of the trigger lock or bypassing the lock entirely. From a safe handling perspective, introducing a foreign object to the trigger while the firearm could be loaded is very dangerous. Additionally, long guns (rifles, shotguns) are typically not considered "drop-safe" as handguns are. Therefore, merely restricting access to the trigger does not mechanically ensure that a round, which could have been chambered before and sometimes after a trigger lock is installed, will not be fired. What is needed is a firearm lock that is affordable, secure, quickly accessible, easily transportable, and is very conveniently utilized with the firearm. In the context of this specification, "quick access" means access on the order of seconds, not minutes.

BRIEF SUMMARY OF THE INVENTION

The present firearm lock invention is a biometric electromechanical locking system integrated firearm safety device.

The device safely locks firearms, such as AR-15 and M4 model rifles, by securing the firearm lock into the firearm chamber through the ejection port to prevent rounds from being fired. The firearm lock uses an electrical biometric sensor that can be used to quickly unlock the firearm lock from the firearm. The firearm lock can also incorporate a mechanical backup unlock mechanism that can be used if a replacement battery is unavailable or if the electrical components fail and cannot be used to unlock the firearm lock. The firearm lock is an independent structure that does not require an invasive installation process such as replacing firearm parts or pieces to use the firearm lock with the firearm.

The firearm lock can be locked by sliding a chamber plunge portion of the firearm lock into the ejection port of the firearm. A firearm lock can slide back in the ejection port so that a rear chamber lock can extend under a rear edge of the ejection port. To secure the device inside the firearm, the user can slide a push pin lever forward which advances the chamber plunge block forward into place in the firearm chamber. The chamber plunge can then be moved forward so that a portion of the chamber plunge extends under a front edge of the ejection port and into a barrel extension portion of the firearm. The firearm lock secures the firearm chamber by retaining the firearm bolt assembly and firing mechanism in the rear of the rifle chamber, mechanically preventing any forward movement of the bolt assembly and firing pin. In some embodiments, the firearm lock may also function as an indicator that there is not a round in the chamber.

The locking mechanism of the firearm lock can include a deadbolt that engages with the chamber plunge portion of the firearm lock when the device is in the locked configuration, forcing the chamber plunge to stay interlocked with the rifle. The deadbolt engagement can be with an intermediary plunge interlock portion. The deadbolt can be retracted by a motor that pulls the deadbolt via a gear and rack or via a cam mechanism. The deadbolt is otherwise retained in the locked position by a spring, having a high ratio of spring force to deadbolt mass, and can be further retained by the motor gear preventing rearward motion of the deadbolt when the motor is not pulling on the deadbolt. The firearm lock can prevent the bolt assembly from moving forward to chamber a round even with a loaded magazine seated.

The locking actuator can be controlled by a biometric sensor such as a fingerprint reader that can be coupled to a circuit board that includes a processor and a memory that stores biometric data for one or more authorized users. The biometric data can be added to the memory by performing a setup process. A power source such as batteries can be used to power the electrical components. When a user wants to unlock the firearm lock, the user can input their biometric data into the biometric sensor coupled to the processor. For example, a user can place a finger on the fingerprint reader. The processor can then compare the input biometric data to the stored authorized user biometric data. In some embodiments, a biometric sensor can be a fingerprint reader and the memory can store the finger data of authorized users. When an authorized fingerprint is read by the fingerprint sensor, the processor can confirm that the biometric data matches the stored authorized user data. The processor can then transmit a signal to the motor to retract the deadbolt from blocking the plunge interlock. A plunge spring can then retract the chamber plunge into the insert housing. The retracted chamber plunge allows the insert portion of the firearm lock to be manually removed from the ejection port of the firearm.

The firearm lock can include a mechanical backup, manual override unlock mechanism that can allow the firearm lock to be unlocked without using the biometric sensor. In some embodiments, the manual override mechanism can include a combination lock. When the proper combination is input, the manual override mechanism can be turned or actuated to disengage the plunge interlock from the chamber plunge. In some other embodiments, the manual override mechanism can include a key lock. When a proper key is inserted into the key lock and turned, the key lock can disengage the plunge interlock from the chamber plunge. When the plunge interlock is disengaged, the chamber plunge can bypass the deadbolt and the chamber plunge spring can retract the chamber plunge into the housing so the firearm lock can be removed from the firearm which can then be used as a fully functional firearm.

The insert portion of the firearm lock can fit into the ejection port of the AR-15 which is universally compatible with military specification (MIL-SPEC) AR-15s/M4s. When installed, the firearm lock can protrude out of the side of the AR-15 to block the front takedown pin preventing the upper and lower receiver from being separated without proper removal of the firearm safety device. The invention can be generally adapted to any weapon having a chamber and is therefore not limited to the AR-15/M4 family of firearms.

The insert portion of the firearm lock can be secured to the firearm through the ejection port to the chamber to lock and prevent the use of the firearm. The firearm lock can allow the firearm to hold a seated and loaded magazine while remaining secure in the ejection port to prevent unauthorized or accidental use. The firearm lock can also prevent storage of the firearm from having "one in the chamber" and a double feed of bullets. The firearm lock can incorporate a quick detachable design which allows quick access to the firearm when the owner needs to use the firearm.

The firearm lock can have a compact and easily transportable design. The firearm lock design can be easily modified to lock and unlock almost any firearm. The firearm lock does not require any modification to the firearm. The firearm lock is designed to be tamper resistant so that if an unauthorized or unwanted user attempted to smash or pry the firearm lock device in an attempt to remove it, the force would likely result in damage to the firearm chamber, a key component of the firearm. An embodiment of the device may include features on or in the housing specifically to facilitate rendering the firearm inoperable if forcibly removed. The firearm lock is shock resistant by design with an internal housing and electronic components being potted. The firearm lock is energy efficient and has a very long battery life because the electrical components have a sleep function for the biometric fingerprint sensor that draws very little electrical power. Some embodiments of the firearm lock can utilize a capacitive touch biometric fingerprint sensor. The firearm lock can also act as a chamber flag visual indicator on a firing line.

The inventive features of the firearm lock dramatically improve upon prior art devices. The firearm lock design provides a high level of security, allows quick access to the firearm, is easily transportable, requires no firearm modification for installation, and is affordable (approximately in the $250 per unit range). The firearm lock requires no physical key and uses an electronic biometric lock mechanism. In addition to being a firearm safety device, the design also blocks the chamber allowing the device to act as a safe chamber flag on a firing line in application. The firearm safety device quickly goes from a locked safe weapon to a ready to fire weapon in seconds, not minutes. All of these novel attributes make the firearm safety device a desirable alternative to adopt.

For easy reference, below is a summary of reference numbers and component names referred to throughout this specification.

101 Gun Lock
103 Chamber Plunge
105 Plunge Spring
109 Push Pin
115 Control Board
117 Control Board Mount
119 Biometric Sensor

121 Battery
123 Upper Housing
124 Housing Cover
125 Housing Insert
127 Left Housing
128 Takedown Pin Blocker
129 Right Housing
131 Rear Chamber Lock
133 Chamber Insert
135 Battery Cover
136 Battery Case
137 Pushpin Slot
139 Override Lock
141 Override Mount
143 Override Adapter
145 Override Lock Tongue
147 Wipe Texture
153 Plunge Interlock
155 Plunge Interlock Pins
177 Setup Button
179 Setup Button Blocking Screw
181 Motor
183 Motor Mount
185 Motor Gear
189 Deadbolt
191 Deadbolt Spring
193 Deadbolt Rack
195 Deadbolt Guide Rod
197 State Sensor
199 State Sensor Mount
201 Firearm
203 Ejection Port
205 Barrel Extension
207 Bolt Assembly

DETAILED DESCRIPTION OF THE INVENTION

Figure 1:
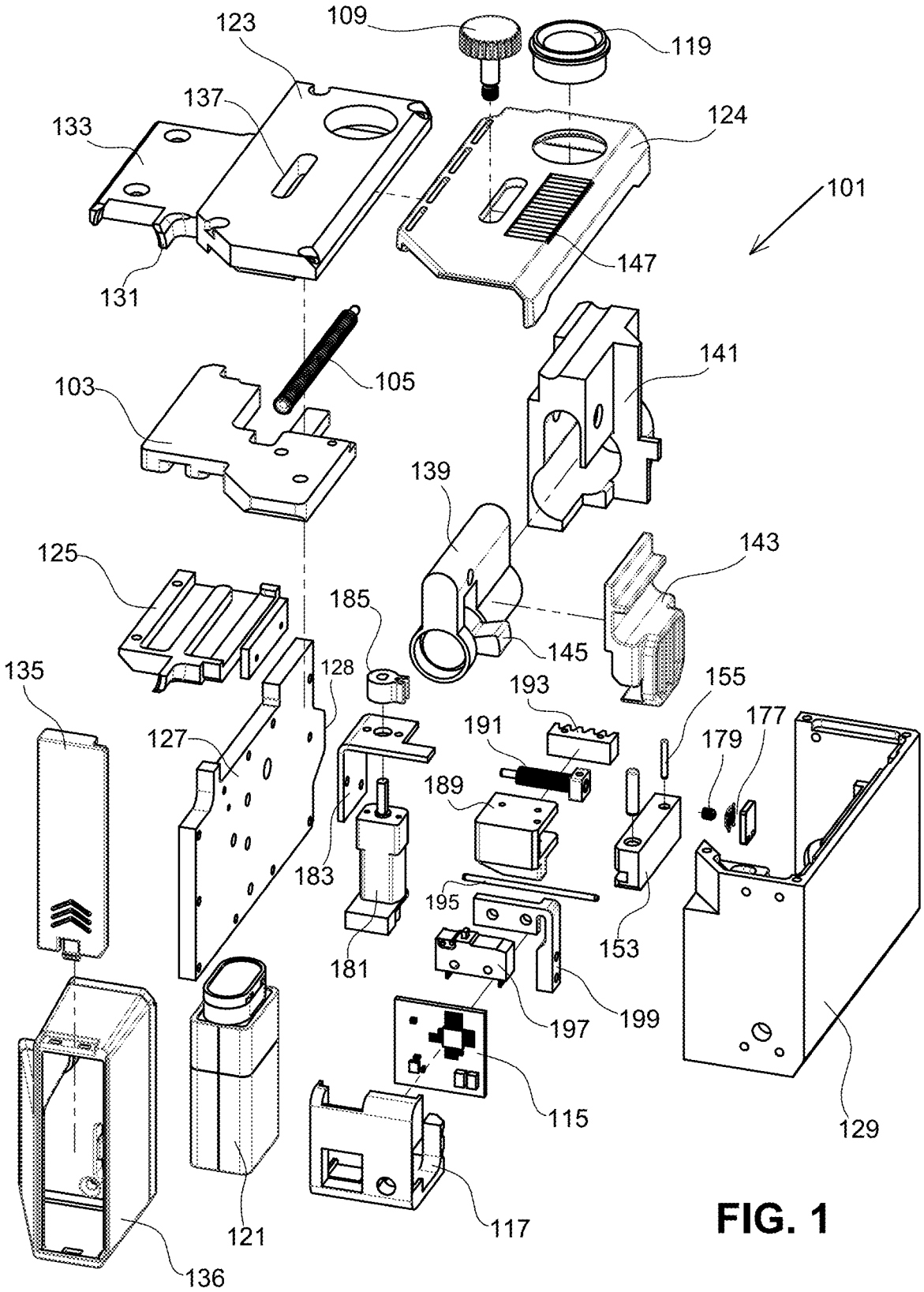
FIG. 1 is an exploded view of an embodiment of a firearm lock apparatus.

The firearm lock is used to prevent unauthorized use of a firearm. With reference to FIG. 1, the illustrated embodiment of the firearm lock 101 can comprise the following primary components: a chamber plunge 103, a plunge interlock 153 and 155, a deadbolt 189, 191, 193, an unlocking actuator 181 and 185, an override lock 139, 141, 143, a biometric sensor 119, a control board 115, and batteries 121. These components can be mounted in a firearm lock housing assembly that can include: an upper housing 123, a housing chamber insert 125, a left housing 127, and a right housing 129. The housing assembly components 123, 125, 127, 129 and the chamber insert 133 can be made of a high strength material such as steel, aluminum, titanium, glass-filled polymers, etc.

The chamber plunge 103 can have a retractable locking portion and a main portion. A plunge return spring 105 can be coupled to the chamber plunge 103 to return the chamber plunge 103 in the chamber insert 133 when the firearm lock 101 transitions to the unlocked position. In the unlocked position, the firearm lock 101 can be removed or inserted into the firearm ejection port 203. The plunge return spring 105 will be compressed when the chamber plunge 103 is extended out of the chamber insert 133 into a locked position. In the locked position, the locking portion of the chamber plunge 103 extends out from the chamber insert into the chamber of the firearm to lock and prevent the firearm from being used.

In the locked position, chamber plunge 103 is prevented from retracting by its connection to plunge interlock 153, via plunge interlock pins 155. Plunge interlock 153 is prevented from retracting by deadbolt 189 being pushed into the path of plunge interlock 153 under the force of deadbolt spring 191. Deadbolt 189 is supported by the body of the right housing component 129. Unlocking motor 181 can be coupled to deadbolt 189 via a motor gear 185, which can pull on deadbolt rack 193 to retract deadbolt 189 out of the path of plunge interlock 153. When motor 181 is appropriately energized, the retraction of deadbolt 189 allows chamber plunge 103 to retract under the force of plunge return spring 105.

The biometric sensor 119 is used to detect a physical characteristic of a firearm user. In the illustrated example, the biometric sensor 119 can be a fingerprint reader. A control board 115 can be electrically coupled to the biometric sensor 119 and the unlocking motor 181. The control board 115 controls the unlocking motor 181 to remove the deadbolt 189 from the path of plunge interlock 153, allowing free movement of chamber plunge 103 when the firearm lock 101 is unlocked. A power supply provides electrical power to the control board 115 and the unlocking motor 181. The firearm lock 101 can also include a manual override mechanism that can include an override lock 139, an override mount 141, and an override adapter 143 that is coupled to the plunge interlock 153 to manually disengage plunge interlock 153 from chamber plunge 103. The housing components 125, 127, 129, 133 are coupled to the chamber insert and surround the control board 115, the control board mount 117, the power supply 121, and the unlocking motor 181.

FIGS. 2-13 illustrate different views of the firearm lock 101 in the unlocked and locked positions. The general steps for securing the firearm lock 101 to the firearm 201 are:

1. The chamber insert 133 of the firearm lock 101 while unlocked is inserted into the ejection port 203 of the rifle firearm.
2. The chamber plunge 103 is extended out of the chamber insert 133 by the user by sliding the push pin 109 forward so that a portion of the chamber plunge 103 extends past the front edge of the ejection port 203 into the chamber of the firearm.
3. Subsequently, further pushing by the user will ensure the firearm lock has been moved backwards in the ejection port 203 and that the rear chamber lock 131 is under a rear edge of the ejection port 203.
4. In the fully extended position, the plunge interlock 153 will be past deadbolt 189, allowing deadbolt spring 191 to push deadbolt 189 forward to block rearward movement of chamber plunge 103.

Firearm Lock 101 Operation Steps

Figure 2:
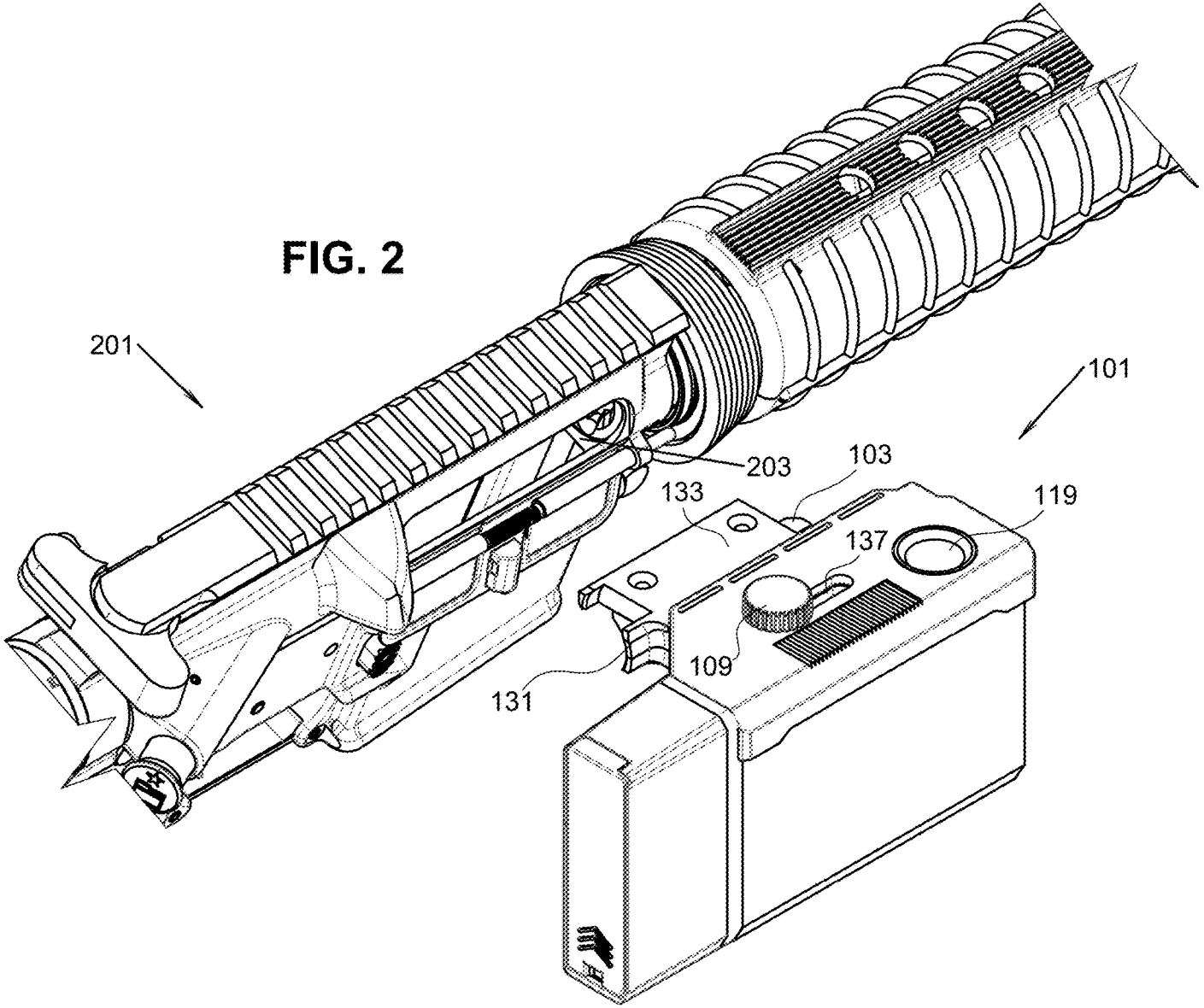
FIG. 2 is a perspective view of an embodiment of the firearm lock device in unlocked position.

FIG. 2 illustrates an embodiment of a firearm 201 and a firearm lock 101. The firearm lock 101 can be idle in an unlocked state when the chamber plunge 103 is fully retracted into the chamber insert 133. The ejection port 203 should be open and clear without a cartridge so that the firearm lock 101 can be inserted.

Figure 3:
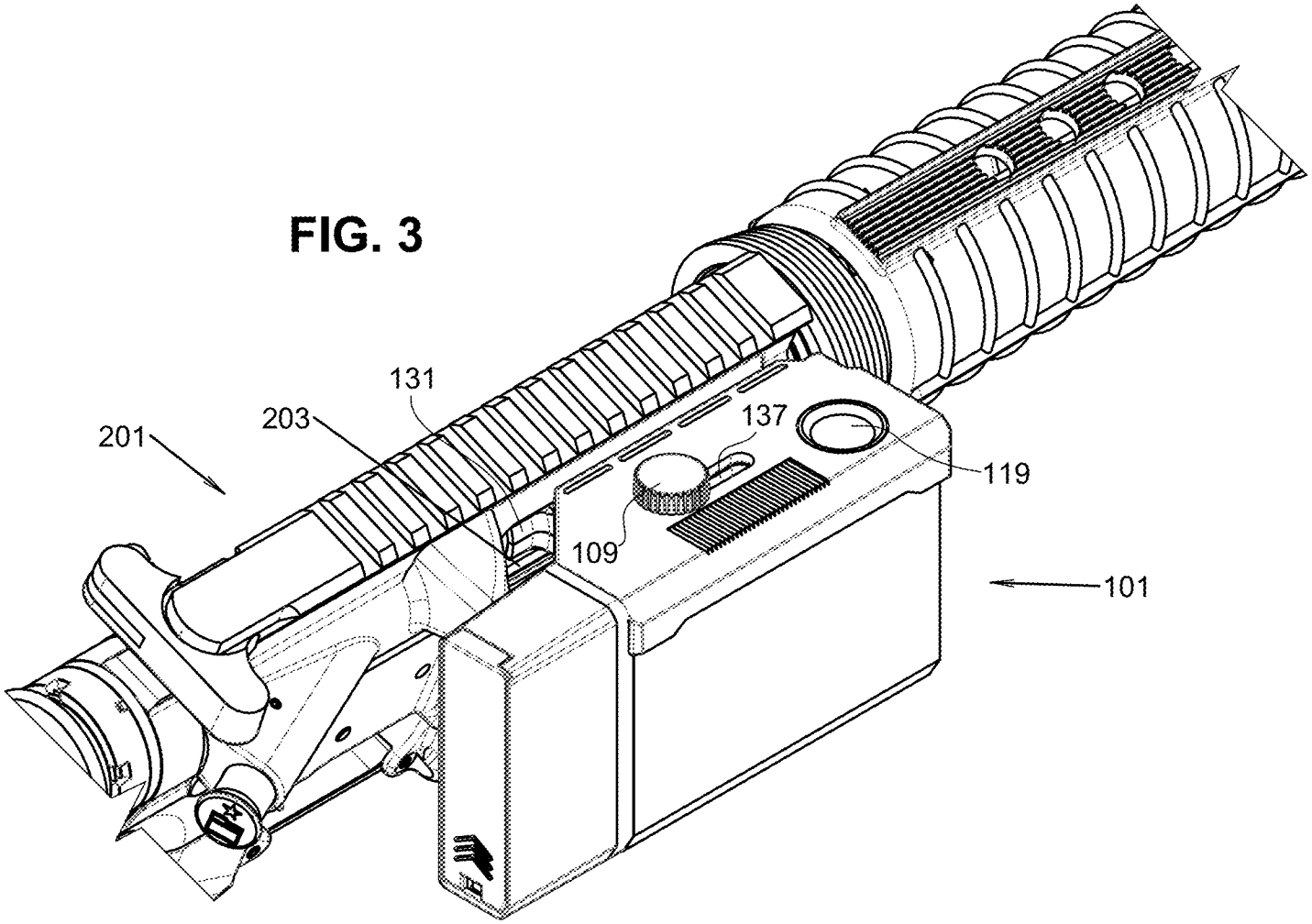
FIG. 3 is a perspective view of an embodiment of the firearm lock device inserted into a firearm in the unlocked position.

With reference to FIG. 3, the firearm lock 101 has been inserted into the firearm 201 and is ready to be actuated into the locked position. To lock a firearm 201, the rear chamber lock 131 can be placed into the rear portion of the ejection port 203 and the chamber insert 133 can be inserted into the rifle ejection port 203. Once inserted, the chamber plunge 103 can be extended forward from the chamber insert 133 manually by sliding the push pin 109 forward to the end of the pushpin slot 137. This can cause the front portion of the chamber plunge 103 to slide into the chamber of the firearm forward of the ejection port 203. In the forward position, the chamber plunge 103 is locked in place and the firearm lock 101 is locked in the firearm 201.

Figure 4:
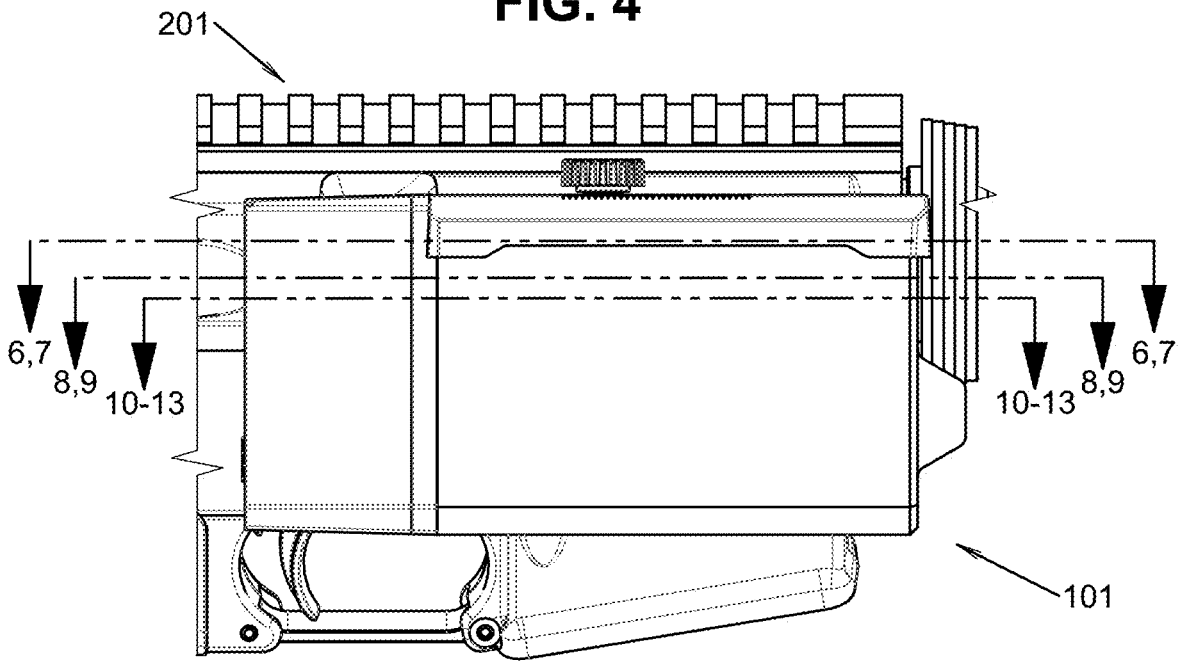
FIG. 4 is a side view of an embodiment of the firearm lock device inserted into a firearm defining section view depths.
Figure 5:
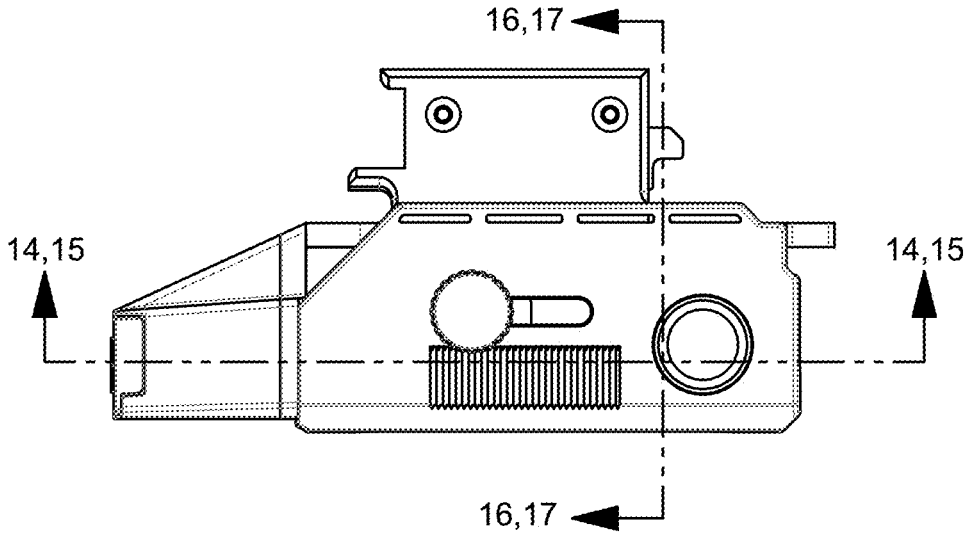
FIG. 5 is a top view of an embodiment of the firearm lock device defining section view depths.

FIG. 4 illustrates a side view of an embodiment of the firearm lock 101 inserted into the ejection port 203 of the firearm 201. FIG. 5 illustrates a top view of an embodiment of a firearm lock 101.

Figure 6:
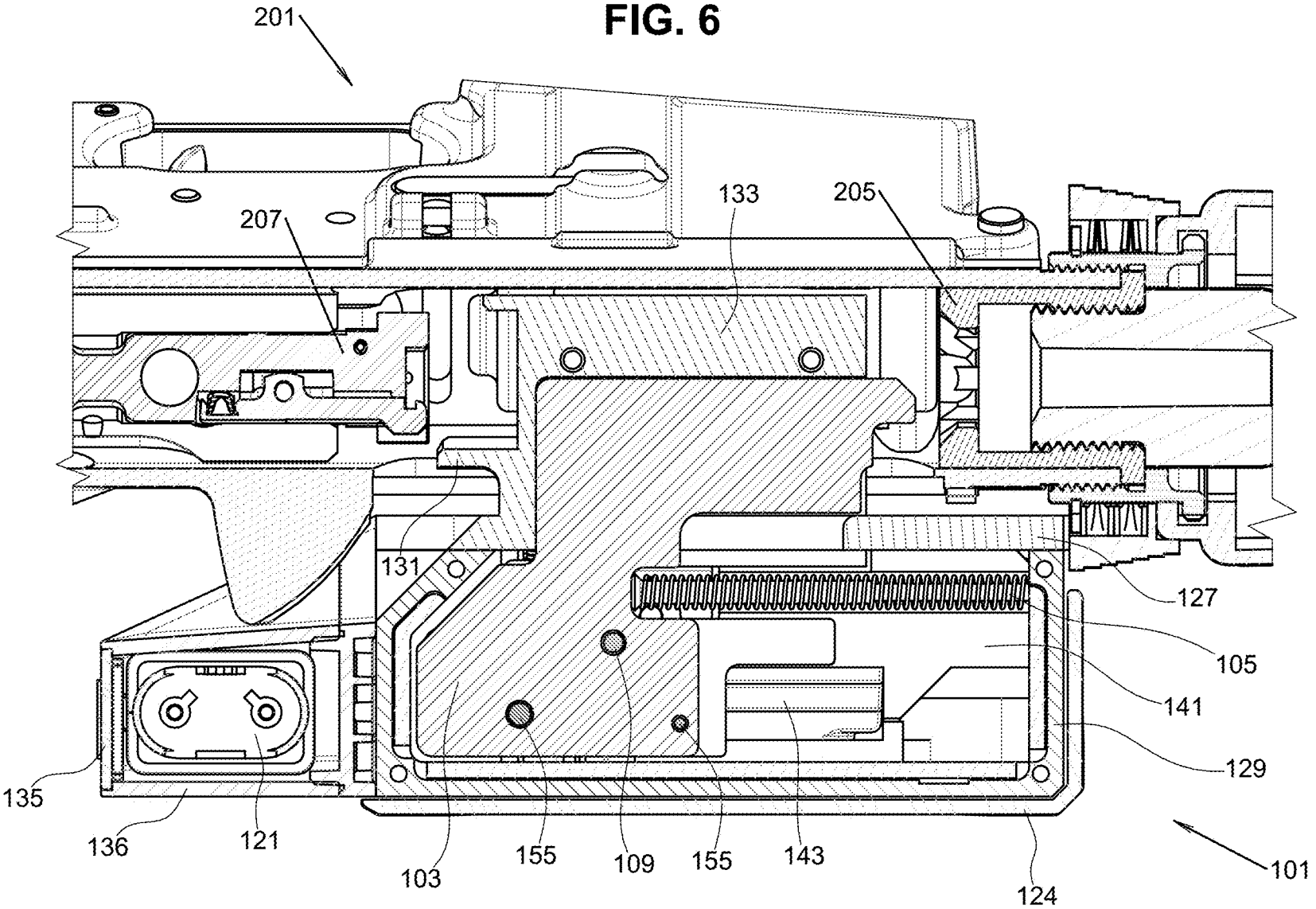
FIG. 6 is a cross section top view of an embodiment of the firearm lock device inserted into a firearm in the unlocked position, depicting how the device relates to the rifle.
Figure 7:
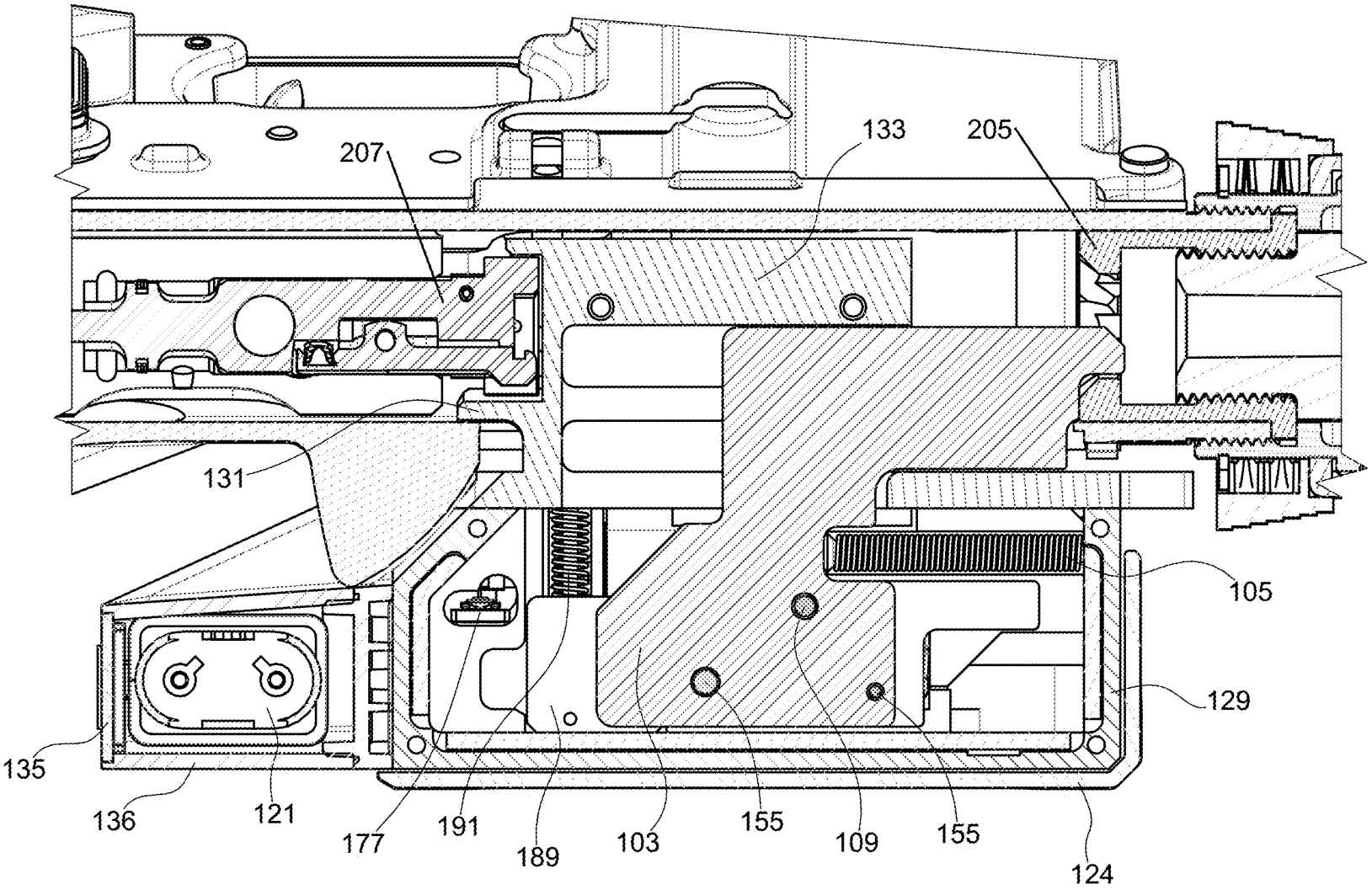
FIG. 7 is a cross section top view of an embodiment of the firearm lock device inserted into a firearm in the locked position, depicting how the device relates to the rifle.

FIGS. 6 and 7 illustrate cross section views of an embodiment of the firearm lock 101 in the firearm 201. FIG. 6 illustrates the firearm lock 101 in the idle unlocked state with the chamber plunge 103 retracted into the chamber insert 133. The rear chamber lock 131 can be placed into the rear portion of the ejection port 203 and the chamber insert 133 can be inserted into the rifle ejection port 203. In the idle unlocked state, the firearm lock 101 can be easily inserted or removed from the ejection portion 203 of the firearm 201. FIG. 7 illustrates the firearm lock 101 in the engaged locked state. The rear chamber lock 131 is placed into the rear portion of the ejection port 203 and the chamber plunge 103 extended out of the chamber insert 133 and into the barrel extension 205 portion and the front of ejection port 203 of the firearm 201. With the firearm locked in place, the firearm 201 cannot be used.

Figure 8:
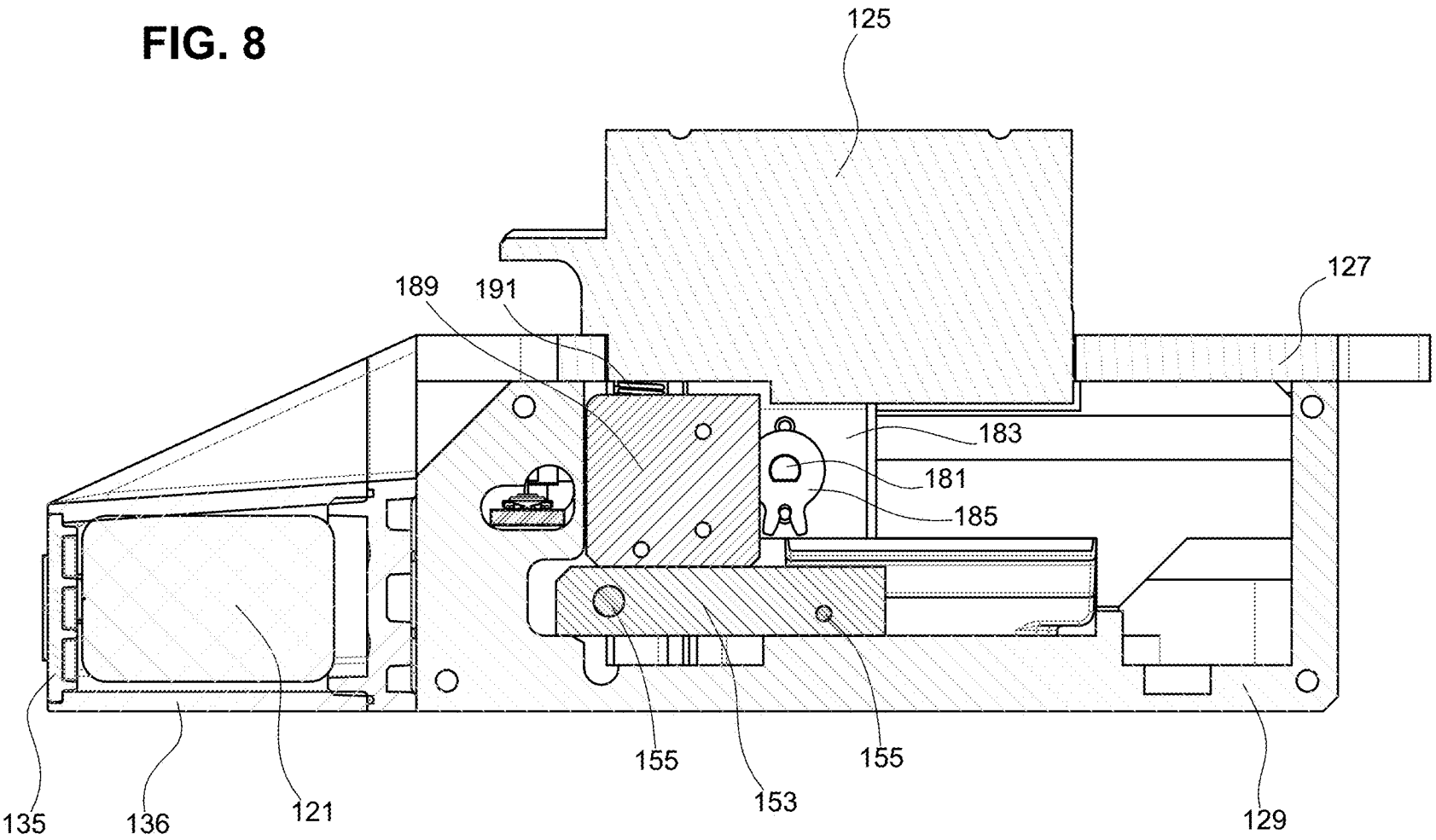
FIG. 8 is a cross section top view of an embodiment of the firearm lock device in the unlocked position, depicting the interaction between the deadbolt and plunge interlock.
Figure 9:
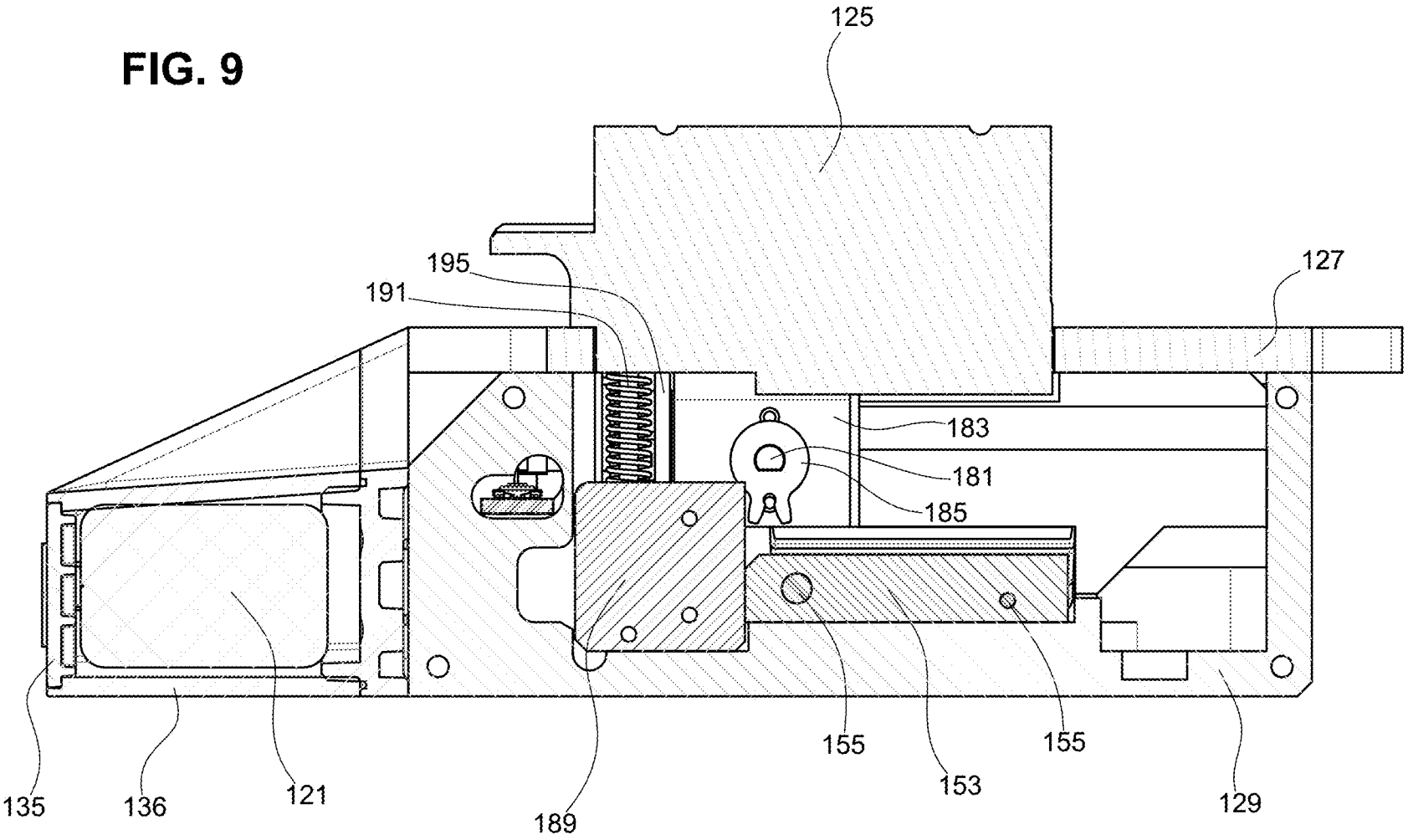
FIG. 9 is a cross section top view of an embodiment of the firearm lock device in the locked position, depicting the interaction between the deadbolt and plunge interlock.

FIGS. 8 and 9 illustrate cross section views of an embodiment of the firearm lock 101. FIG. 8 illustrates the firearm lock 101 in the idle unlocked state and FIG. 9 illustrates the firearm lock 101 in the engaged locked state. In FIG. 8, the chamber plunge 103 is retracted and plunge interlock 153 is in the rearward position, connected to chamber plunge 103 via plunge interlock pins 155. Deadbolt spring 191 is compressed and pushing deadbolt 189 into the side of plunge interlock 153. In FIG. 9, the chamber plunge 103 is extended and plunge interlock 153 moves past deadbolt 189, allowing deadbolt 189 to move outwards under force from deadbolt spring 191. In this position, deadbolt 189 prevents any rearward motion of plunge interlock 153 and chamber plunge 103, supported by the right housing part 129. In both figures, motor gear 185 is positioned to not interfere with the movement of deadbolt 189.

The firearm lock 101 can prevent the use of a firearm while in a locked state. The firearm lock 101 may only be unlocked using the biometric sensor 119 when authorized users input their biometric data (an anatomically unique feature of an individual) or by a manual override. For example, if the biometric sensor 119 is a fingerprint sensor, the firearm lock 101 can only be unlocked when an authorized fingerprint is placed on the fingerprint sensor. The firearm lock 101 can be quickly attached to and detached from the firearm. The firearm lock 101 can be tamper-resistant and may cause damage to the firearm if someone attempts to forcibly remove the firearm lock 101. In some embodiments, the battery 121 life can be at least a year.

When a fingerprint is placed on a contact surface and read by the fingerprint reader, the biometric sensor module 119 analyzes the biometric fingerprint data. The biometric sensor module 119 comprises the sensor and in some embodiments, an integrated control unit, a memory, and on-board biometric verification algorithms. Fingerprint data can be stored in the fingerprint sensor module's microcontroller's memory or communicated to and stored on the main control board 115 microcontroller. The control unit of the biometric sensor module 119 communicates with the control board 115. More specifically, the control unit of the biometric sensor module 119 communicates that a fingerprint is present, and then whether the fingerprint is a valid fingerprint. Control board 115 communicates with biometric sensor 119 to trigger events such as verification, enrollment, and reset. The control unit of the biometric sensor module 119 can compare the biometric data to the stored biometric data to determine if the fingerprint is valid and associated with an authorized user of the firearm.

If the fingerprint is not valid, the control board 115 will not unlock the firearm lock. If the fingerprint is valid, the control board 115 will apply electrical power to motor 181 to retract deadbolt 189. The plunge interlock 153 and chamber plunge 103 will then be free to move and the plunge return spring 105 pushes the chamber plunge 103 rearwards into the chamber insert 133. The firearm lock 101 is returned to an idle unlocked state and can be removed from the firearm.

Unlocking Actuation

Figure 10:
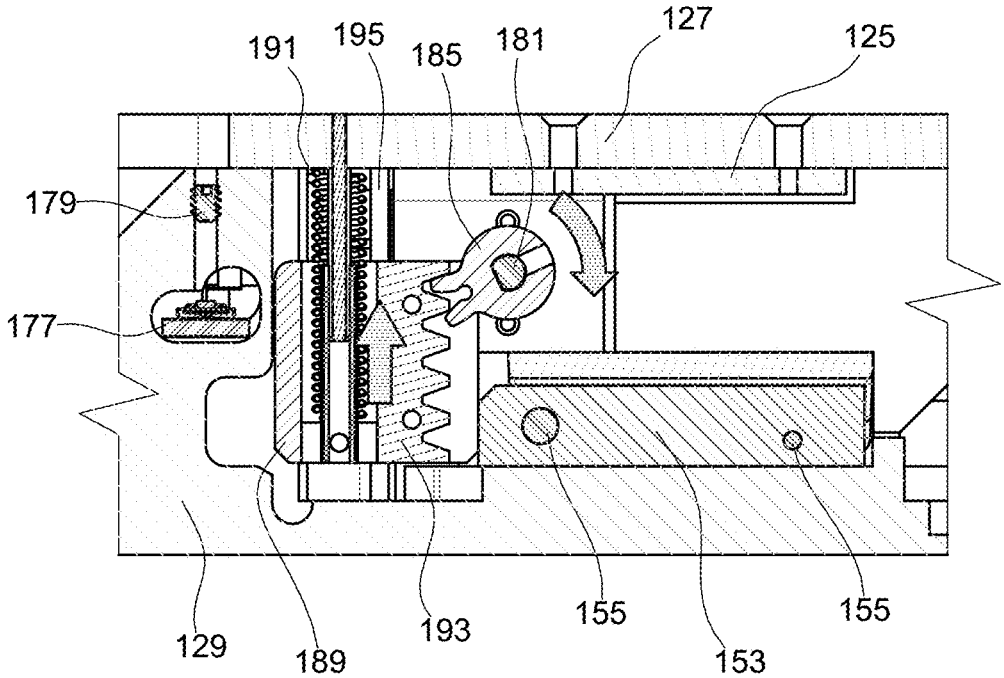
FIG. 10 is a cross section top view of an embodiment of the firearm lock device in the locked position, depicting the motor beginning to unlock the device.

The locking actuator can be an electric motor with a high gear ratio. FIGS. 10, 11, 12, and 13 illustrate deadbolt 189, deadbolt rack 193, motor 181, motor gear 185, and plunge interlock 153 performing an unlocking sequence. In FIG. 10, the device is depicted in the moments after a valid fingerprint is processed by biometric sensor 119 and control board 115 while in the locked state. Motor gear 185 is driven by its rigid connection to motor 181, which is in turn controlled by control board 115. Motor gear 185 can have teeth that mesh with deadbolt rack 193, allowing motor 181 to begin retracting deadbolt 189 against the spring force of deadbolt spring 191. In the state depicted in FIG. 10, plunge interlock 153 is still prevented from rearward motion by deadbolt 189.

Figure 11:
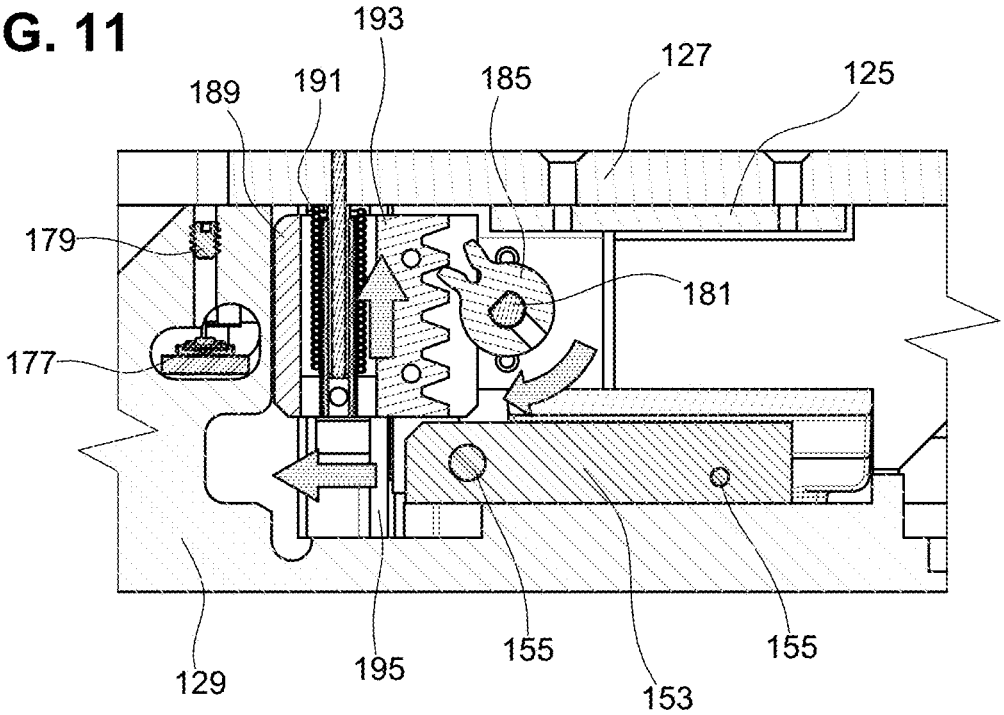
FIG. 11 is a cross section top view of an embodiment of the firearm lock device in an intermediary position, depicting the motor continuing to unlock the device.
Figure 12:
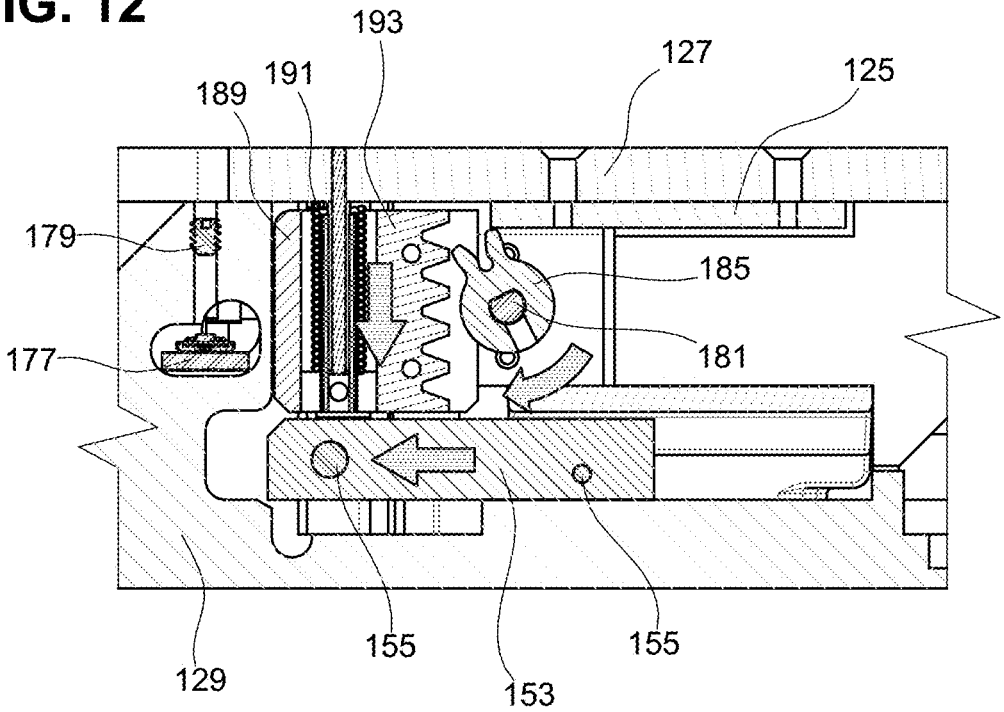
FIG. 12 is a cross section top view of an embodiment of the firearm lock device in an intermediary position, depicting the motor releasing the deadbolt.
Figure 13:
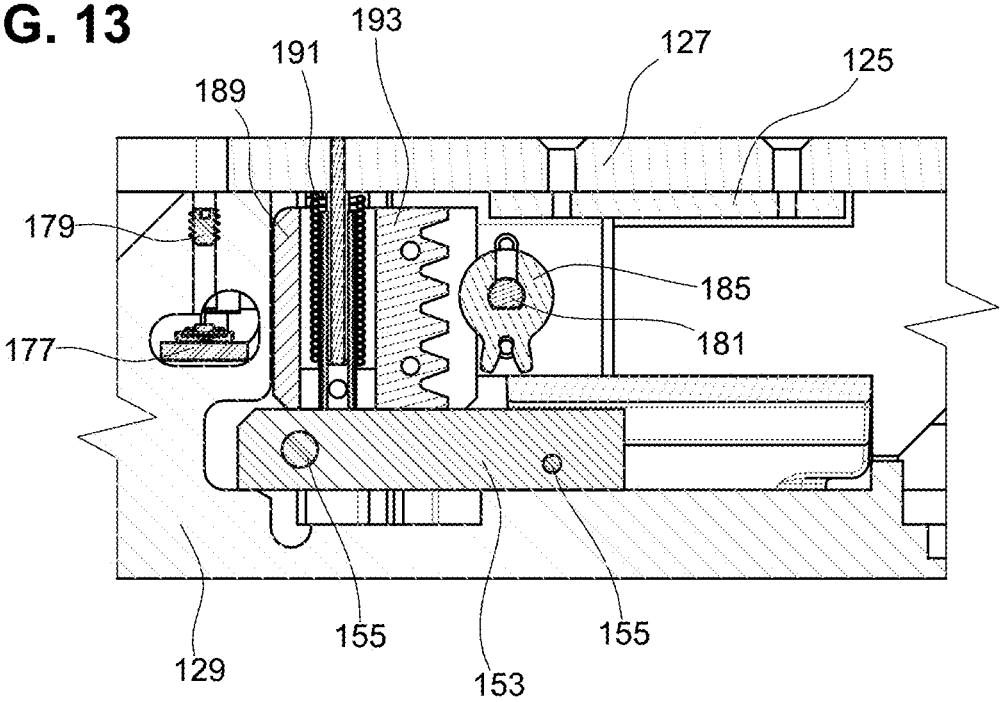
FIG. 13 is a cross section top view of an embodiment of the firearm lock device in the unlocked position, depicting the device returned to an idle state.

In FIG. 11, motor 181 continues to rotate, retracting deadbolt 189 past plunge interlock 153, allowing plunge interlock 153 to begin its rearward motion. The rearward motion of plunge interlock 153 is due to the spring force of plunge spring 105 pushing on chamber plunge 103, which pushes on plunge interlock pins 155, which are rigidly connected to plunge interlock 153. In FIG. 12, motor 181 has rotated further such that motor gear 185 disengages from deadbolt rack 193, allowing deadbolt 189 to begin moving towards plunge interlock 153 under the force of deadbolt spring 191. FIG. 13 depicts the device having completed the unlocking procedure and resting in the unlocked state, allowing firearm lock 101 to be removed from rifle 201. FIG. 13 depicts firearm lock 101 in the same state as depicted in FIG. 8.

Manual Override

With reference to FIGS. 1, 14, 15, 16, and 17, the manual override allows a user with key access authorization rather than biometric authorization to remove the firearm lock and access the firearm in the event the electronics fail or if the battery 121 has insufficient charge with no replacement batteries immediately available. In an embodiment, the manual override can be provided by a half-cylinder key lock contained within the housing. The keyhole for the override lock can be exposed and mounted via a screw on a side of the firearm lock housing that faces the firearm to prevent tampering with the override lock cylinder while the device is locked in a firearm. The design is such that even if tampering occurs, it is unlikely firearm lock 101 can be overridden without the correct key. FIGS. 1, 14, 15, 16, and 17 illustrate a key cylinder lock. In other embodiments, the manual override can use any other type of lock such as a combination lock.

Figure 14:
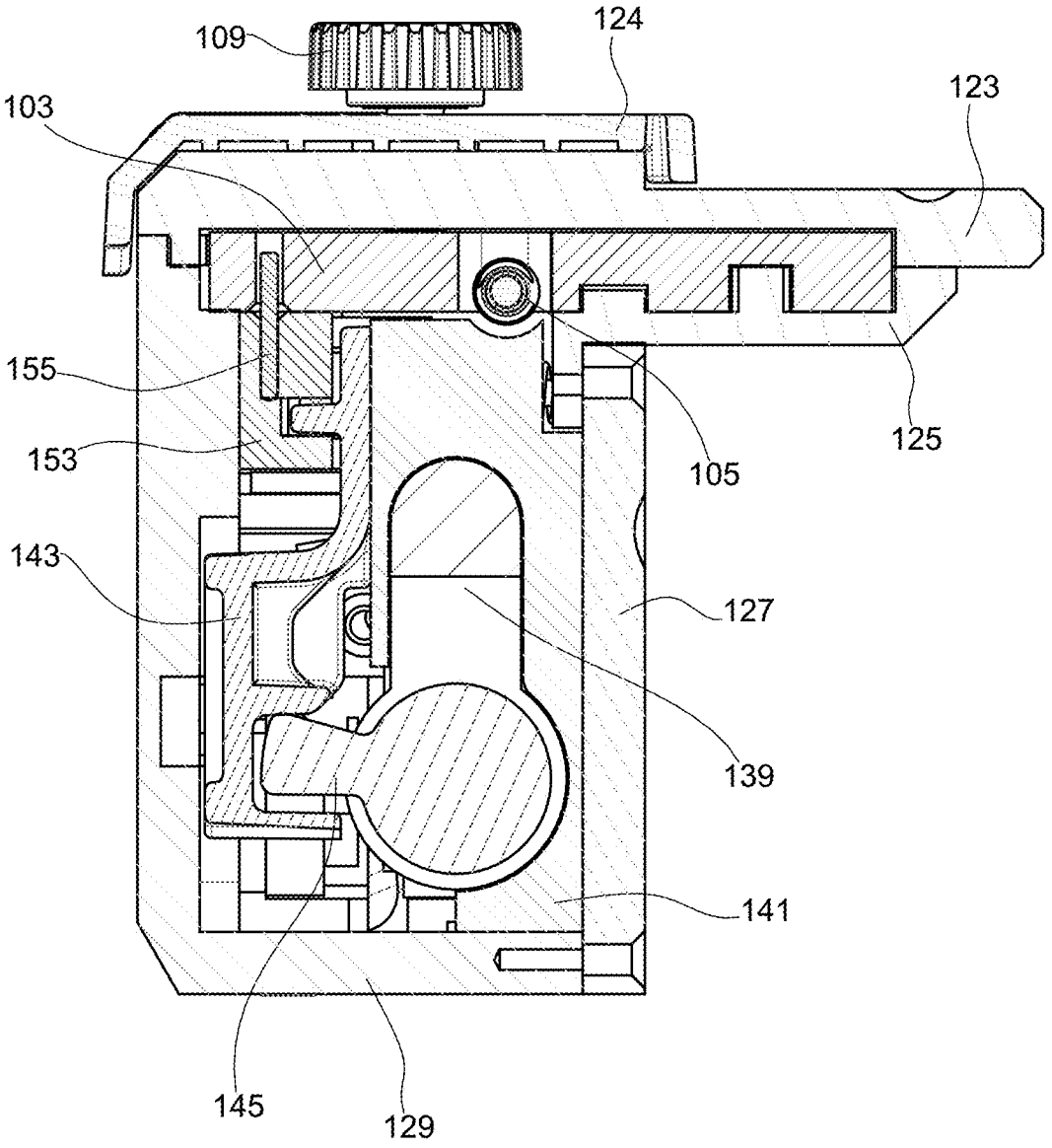
FIG. 14 is a cross section front view of an embodiment of the firearm lock device in the locked position.
Figure 15:
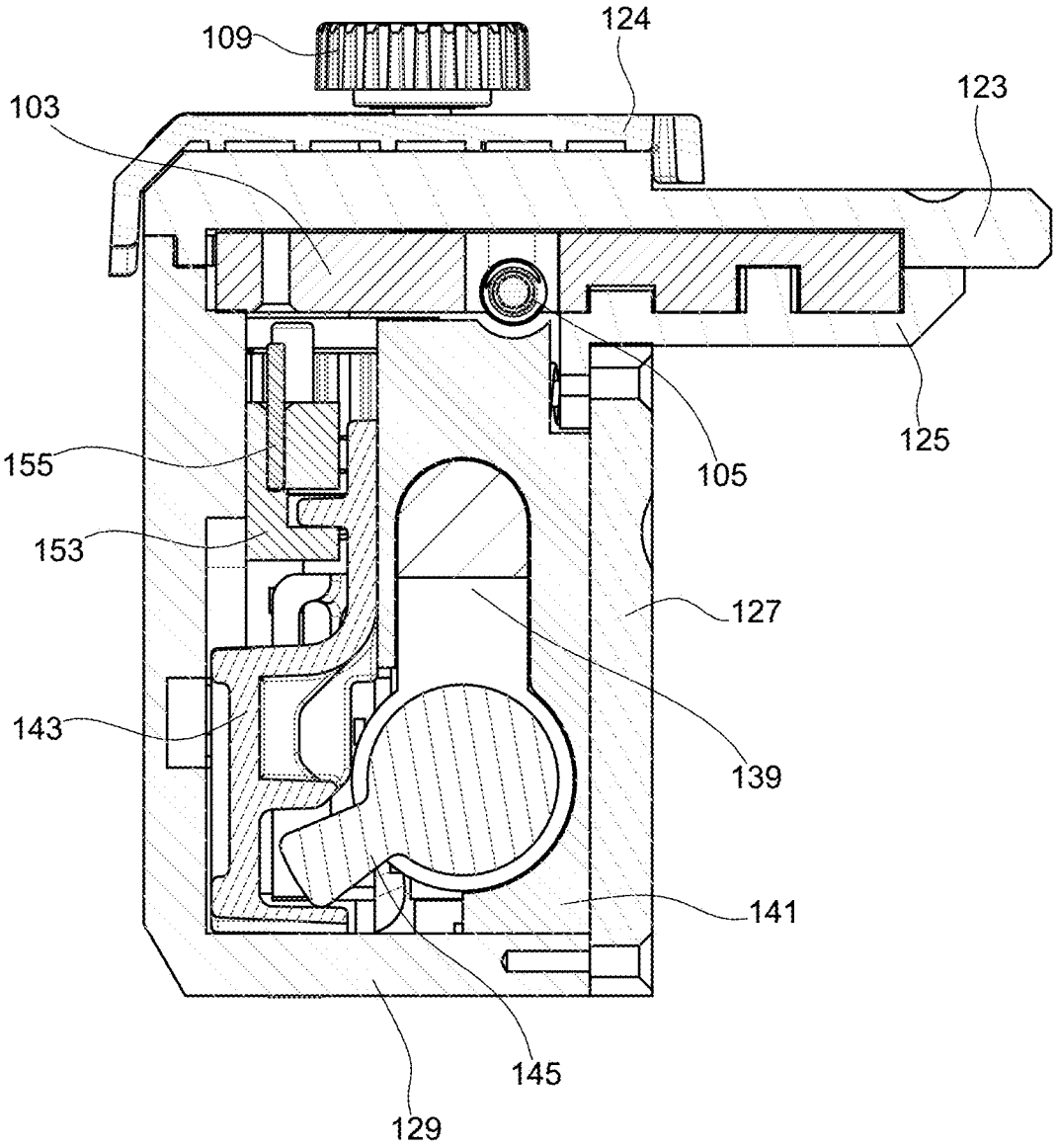
FIG. 15 is a cross section front view of an embodiment of the firearm lock device in the overridden, unlocked position.

The core of the override cylinder lock 139 can have a tongue 145 that rotates with the core of the override lock 139. When the override lock 139 is unlocked, the inserted key can turn or rotate with the cylinder. The rotating override lock tongue 145 engages a bottom portion of the override adapter 143 that also moves downward with the rotating override lock tongue 145. When the override cylinder lock 139 is locked, it makes no physical movement with the other firearm lock components. FIG. 14 depicts firearm lock 101 in the locked state prior to the actuation of the manual override. Override adapter 143 in the upwards position keeps plunge interlock 153 engaged with chamber plunge 103 via plunge interlock pins 155, which are fully inserted into openings in chamber plunge 103. FIG. 15 illustrates firearm lock 101 in the overridden state, with lock cylinder 139 rotated such that override lock tongue 145 pulls down on override adapter 143 and subsequently on plunge interlock 153, disengaging plunge interlock pins 155 from chamber plunge 103.

Figure 16:
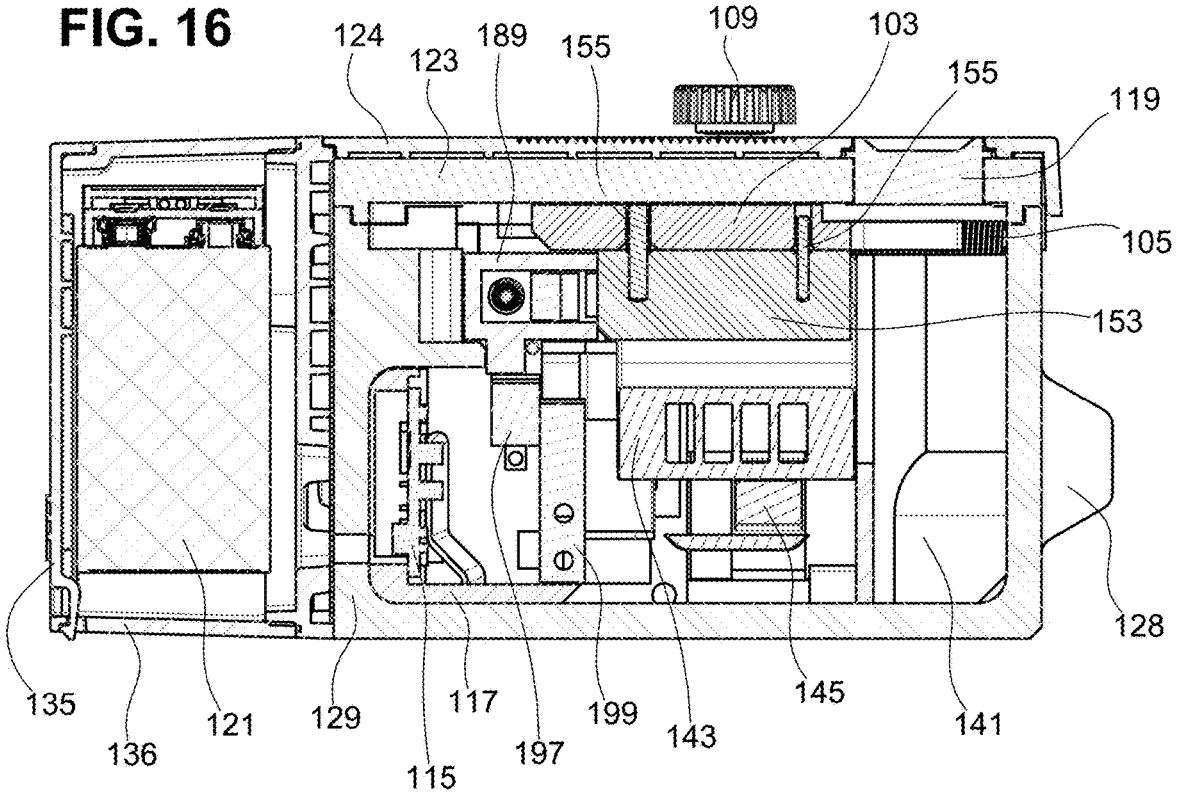
FIG. 16 is a cross-section side view of an embodiment of the firearm lock device in the locked position.
Figure 17:
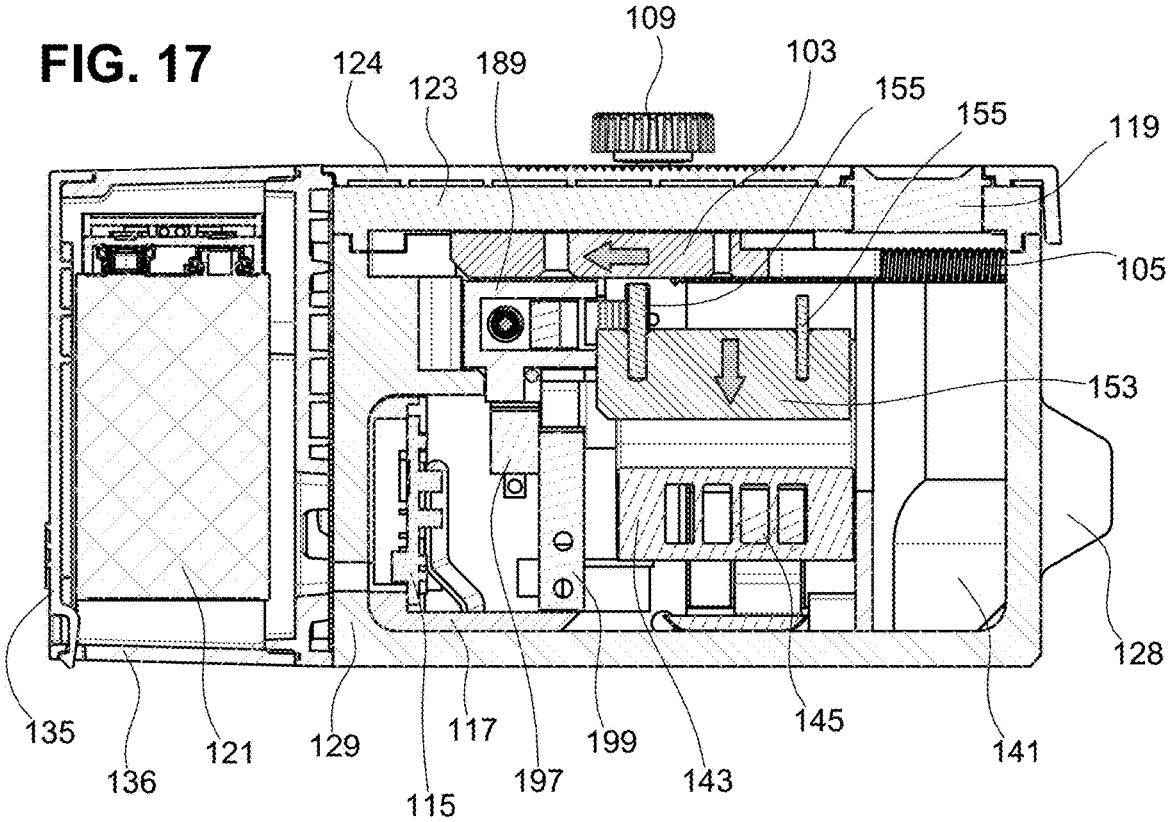
FIG. 17 is a cross-section side view of an embodiment of the firearm lock device in the overridden, unlocked position.

FIG. 16 depicts firearm lock 101 in the initial locked position with plunge interlock pins 155 fully engaged with chamber plunge 103. This state corresponds to the state of FIG. 14, depicting a side view instead of a front view. FIG. 17 depicts firearm lock 101 from the side in a state similar to FIG. 15. Override lock tongue 145 is rotated by the user via a key in override lock 139. Tongue 145 pulls down on override adapter 143, which pulls down plunge interlock 153, removing plunge interlock pins 155 from chamber plunge 103. This allows chamber plunge 103 to freely move rearwards under force from plunge spring 105, bypassing the lockup provided by deadbolt 189. Device 101 is now in an overridden state and cannot be locked until the key is removed by returning chamber plunge 103 to its extended position and reinserting plunge interlock pins 155. While in the overridden state, firearm lock 101 can be removed from ejection port 203 so the firearm 201 can be used.

Dynamic Attack Resistance

Figure 18:
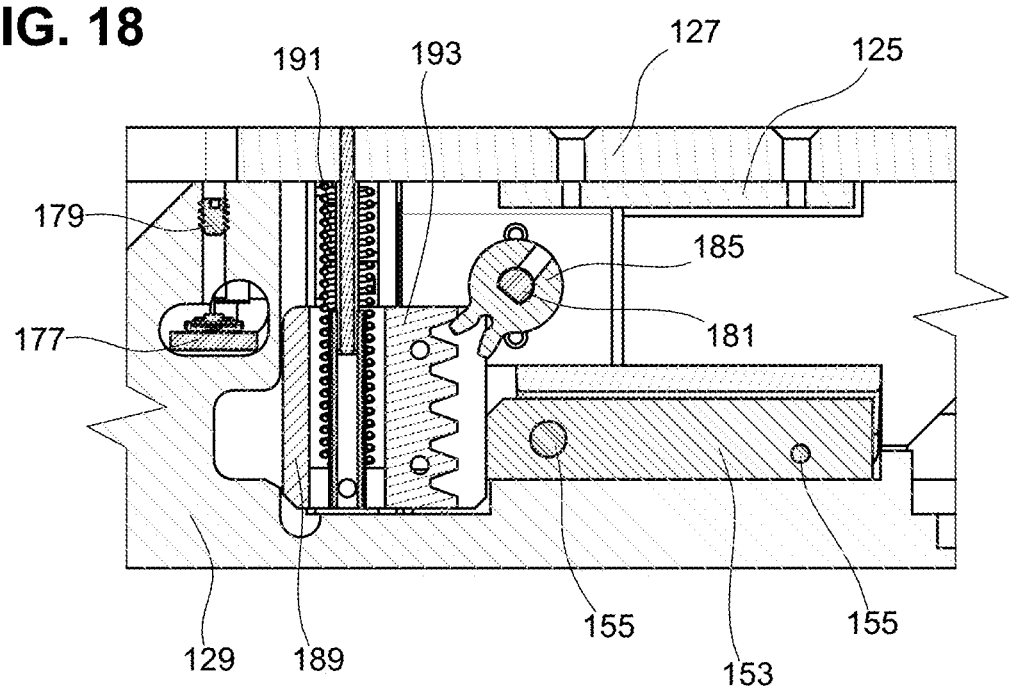
FIG. 18 is a cross section top view of an embodiment of the firearm lock device in the locked position, depicting a motor gear state to resist dynamic attack.
Figure 19:
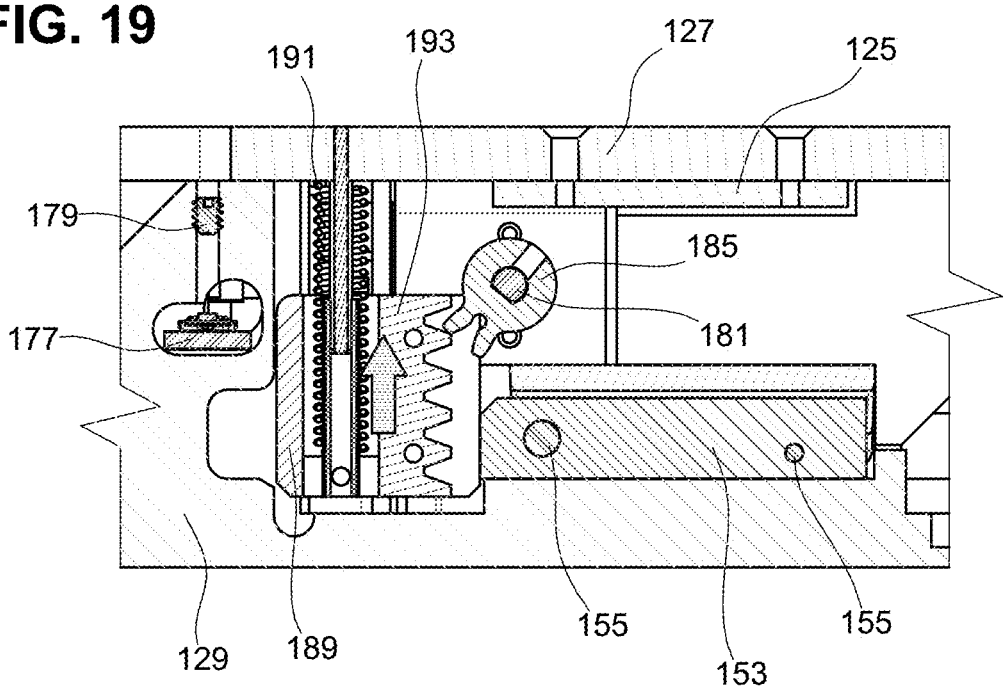
FIG. 19 is a cross section top view of an embodiment of the firearm lock device in the locked position, depicting a dynamic attack.
Figure 20:
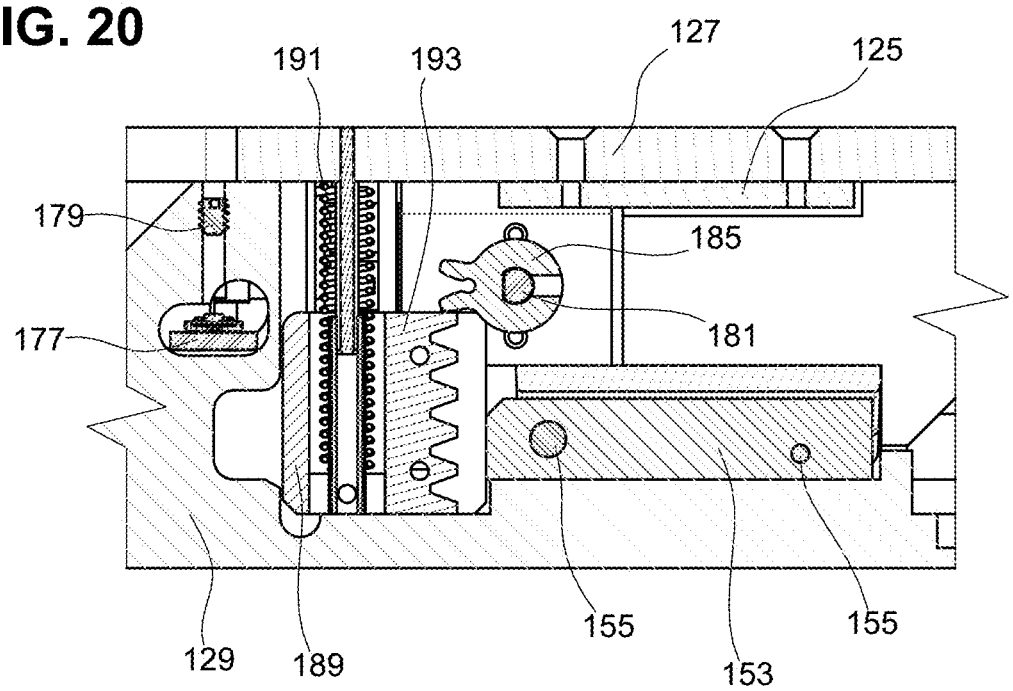
FIG. 20 is a cross section top view of an embodiment of the firearm lock device in the locked position, depicting an alternate motor gear state to resist dynamic attack.

Some embodiments of the device may have additional features to improve resistance to various potential methods of forced unlocking or removal of firearm lock 101. FIGS. 18, 19, and 20 show ways of implementing a feature to increase resistance to a "dynamic attack", where an attacker hits or drops device 101 while it is locked in firearm 201 in such a way to try to force deadbolt 189 to retract under its own inertia. A sufficiently high acceleration could cause the inertia of deadbolt 189 to overpower the force of deadbolt spring 191 plus the friction between deadbolt 189 and the various mating surfaces. With low mass and high spring force, the design of deadbolt 189 and the sizing of deadbolt spring 191 results in very high required accelerations, several times higher than can be typically expected from a drop impact or an intentionally caused impact, providing high passive resistance to dynamic attacks. An additional method to increase dynamic resistance further is to position the teeth of motor gear 185 such that they interfere with the retracting motion of deadbolt 189 if deadbolt 189 is moving under its own inertia rather than by motor 181. FIG. 18 depicts a potential resting position for motor 181 when firearm lock 101 is in the locked state, with motor gear 185 positioned such that it is pulling back deadbolt rack 193 a small distance. This distance is small enough that plunge interlock 153 is still fully prevented from rearward motion by deadbolt 189, but large enough to reliably cause interference between deadbolt 193 and motor gear 185 during a dynamic attack.

FIG. 19 depicts device 101 being subjected to an unlikely dynamic attack of sufficient intensity such that deadbolt 189 is moving under its own inertia against deadbolt spring 191. Deadbolt rack 193 runs into a tooth of motor gear 185 at an angle that transmits force both radially and tangentially to motor 181, reducing the amount of tangential force that could overpower the electromechanical inertia of motor 181. Motor 181 has a high gear ratio, making back-driving its shaft difficult. Some embodiments of firearm lock 101 could use a worm gear drive instead to further prevent back-driving of motor 181. Even in the depicted embodiment, the added resistance of motor 181 would increase the required impact acceleration by a very large amount. Additionally, if the attack successfully starts to back-drive motor 181, that can be sensed by control board 115 via the positional sensing built into motor 181. This can trigger a routine where control board 115 actively applies the full electromotive force of motor 181 to resist the motion of deadbolt 189. Control board 115 can also be programmed to use motor 181 after the impact to actively press deadbolt 189 forwards to maintain mechanical lockup. FIG. 20 depicts an alternate resting position to resist dynamic attack, when compared to FIG. 18. Placing the teeth of motor gear 185 on the rear of deadbolt rack 193 is more robust against positional control inaccuracy and puts motor 181 in position to immediately apply force to push deadbolt 189 forwards if control board 115 senses that an impact has occurred.

To implement these dynamic resistance control strategies, control board 115 must be aware of whether firearm lock 101 is in the locked or unlocked position so that motor gear 185 does not interfere with the movement of deadbolt 189 when firearm lock 101 is transitioning from the unlocked to locked states. This can be implemented via state sensor 197, which detects whether deadbolt 189 is in the compressed or extended state. Alternatively, state sensor 197 can detect the position chamber plunge 103 to determine whether firearm lock 101 is in the locked, unlocked, or overridden states. Control board 115 sensing that firearm lock 101 has entered the locked state can trigger control of motor 181 to position motor gear 185 potentially as illustrated in either FIG. 18 or FIG. 20.

Setup Button

Setup button 177 can be used to trigger biometric management events in firearm lock 101. Procedures for enrolling biometric signatures and for clearing stored biometric signatures can be started by the user's interaction with setup button 177.

An unauthorized user may attempt to remove firearm lock 101 via the device setup button 177. Preventing this can be done physically and with software. Setup button 177 is placed in the right housing part 129 such that its access point is only exposed when firearm lock 101 is not installed in a firearm. When firearm lock 101 is installed in rifle 201, setup button 177 is covered by the side of rifle 201. Additionally, setup button blocking screw 179 can be installed to increase access difficulty. Setup button blocking screw 179 requires space for a removal tool which is not present when firearm lock 101 is installed. Blocking screw 179 can prevent semi-flexible items such as metal wire from being inserted into the access point for setup button 177. For additional security, control board 115 can disable biometric management events if firearm lock 101 is in the locked position, using state sensor 197 to determine the state of firearm lock 101.

Disassembly Prevention

Many models of firearms have parts to allow for easy disassembly for cleaning and maintenance. In particular, the AR-15 style rifles have front and rear takedown pins that allow for separation of the "upper", comprising the chamber, barrel, bolt assembly, and other components; and the "lower", comprising the receiver, trigger assembly, and other components. Disassembly of the firearm could aid in forced removal of firearm lock 101 and would allow for removal and reuse of the disassembled components firearm lock 101 is not locked into. For AR-15 style rifles, the lower half of the rifle includes the receiver, which is the serialized component of the firearm. Embodiments of firearm lock 101 can include features to prevent disassembly, such as takedown pin blocker 128, which is a feature of the left housing component 127. Takedown pin blocker 128 prevents the removal of the front takedown pin on AR-15 style rifles. In an embodiment for AR-15 rifles, firearm lock 101 does not have to prevent removal of the rear takedown pin since bolt assembly 207 interlocks the upper and lower halves of the rifle when the bolt assembly 207 is in the rearward position. The presence of chamber insert 133 prevents bolt assembly 207 from moving forwards enough to allow for separation of the upper and lower halves of rifle 201. By preventing the forward movement of bolt assembly 207 and by covering the front takedown pin with takedown pin blocker 128, disassembly of rifle 201 is prevented.

Tracker

In some embodiments, the firearm lock 101 can also include a tracking device such as an Apple AirTag or similar tracker that uses wireless radio frequency signals to communicate with other radio frequency devices such as smart phones. In some embodiments, the tracker housing will thus either be plastic or rubber on one or more sides, or alternatively, the tracker housing can be a plastic or rubber attachment coupled to the main metal housing. These non-metal housing pieces can be necessary for the radio frequency communications to avoid a loss of signal to and from the tracking device due to interference by metal components. The tracker can have an internal integrated battery or alternatively, the tracker device can be powered by the power supply of the firearm lock.

Firearm Lock Control System

Figure 21:
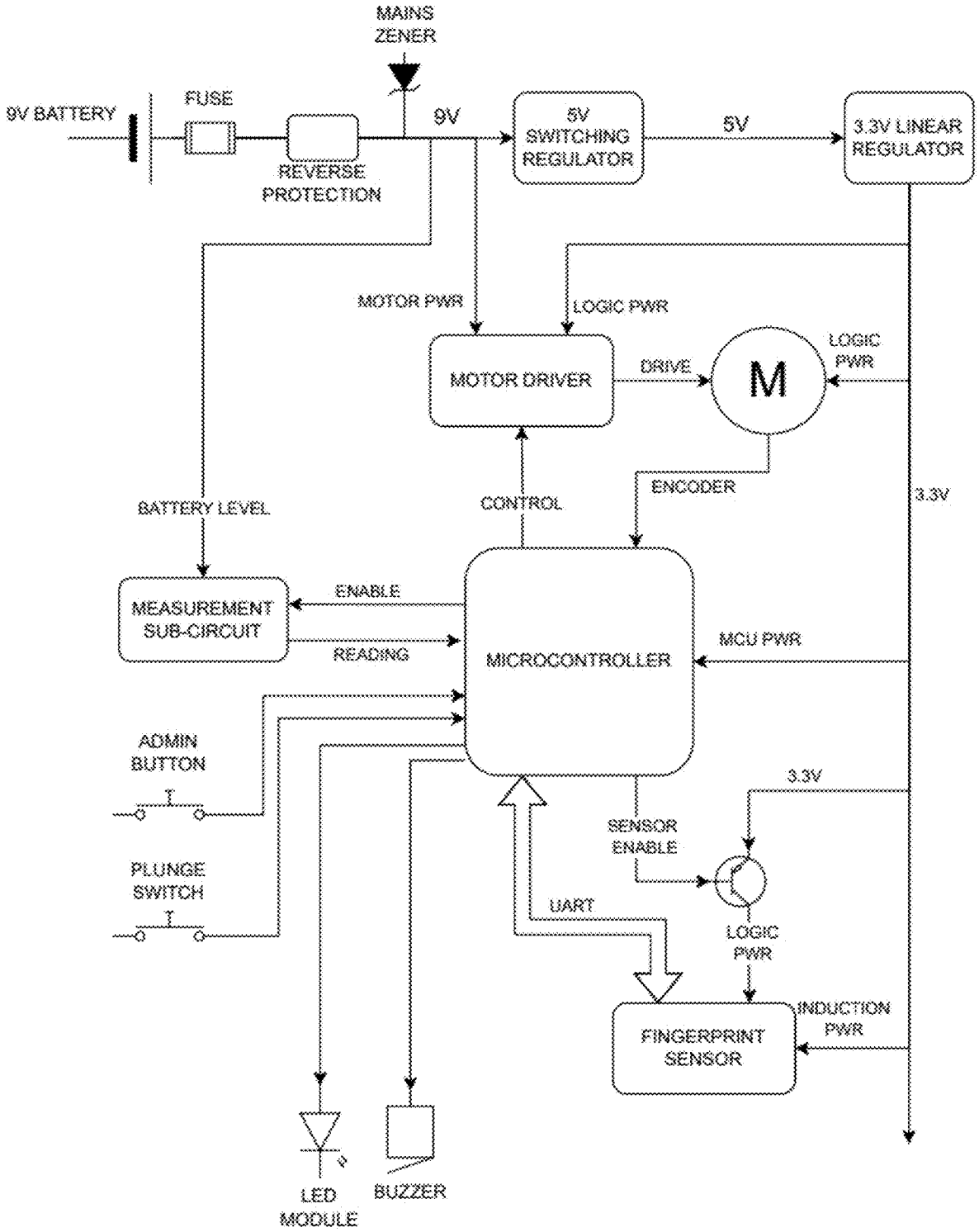
FIG. 21 is a top-level wiring schematic showing the connections of the electrical subcomponents of the control board 115.

With reference to FIG. 21, a block diagram of the firearm lock control system that can include a biometric sensor module 119 that can compare the detected biometric information to biometric information for authorized firearm lock users stored in memory. If the biometric information detected by the biometric sensor module 119 does not match the stored authorized biometric information stored in the memory, the control board 115 will not apply power to the unlocking motor 181 and the firearm lock will remain locked.

The present disclosure, in various embodiments, includes components, methods, processes, systems, and/or apparatus substantially as depicted and described herein, including various embodiments, subcombinations, and subsets thereof. Those of skill in the art will understand how to make and use the present disclosure. The present disclosure, in various embodiments, includes providing devices and processes in the absence of items not depicted and/or described herein or in various embodiments hereof, including in the absence of such items as may have been used in previous devices or processes, e.g., for improving performance, achieving ease, and/or reducing cost of implementation. Rather, as the following claims reflect, inventive aspects lie in less than all features of any single foregoing disclosed embodiment.

Additional Embodiments

Chamber plunge guide track: The guide rail geometry of chamber plunge 103 also provides resistance to a "barrel attack", where an unauthorized user may try to remove the lock by forcing a rode down the barrel of the rifle. When extended, there is only a small portion of the guide rail engaged with the guide track, so when force is applied to the end of the chamber plunge it applies a torque centered around the locking actuator's interlock with the chamber plunge. This encourages the chamber plunge to bind within the housing rather than slide, providing robust resistance to external force. This is a redundant level of physical security, as the chamber plunge already has full mechanical lockup that can resist the full force of a barrel attack. The binding effect merely decreases the chances of success by an additional margin.

Electrical protections: A combination of fuses, diodes, and MOSFETs protects the circuit board from an attacker attaching high and/or reverse voltages to the battery leads in an attempt to force the device to unlock electrically. The reverse voltage protection is also a general protection against the user trying to replace the battery backwards.

Mechanically, the battery leads are wound around a segment of the battery case and adhered in place so that pulling on the battery leads doesn't impact the control board. This is for general quality but also in the extreme off chance that somehow an attacker could cause the board to issue an unlock signal by damaging the power connection.

The device requires power to unlock, and no power to stay locked. Losing power, or a fuse blowing due to an electrical attack, disables the regular operation of the device. The only way to unlock the device in the scenario of blowing a fuse would be to use the manual override. Running out of battery means the device stays locked unless manually overridden until the battery is replaced, at which point regular operation resumes.

Some radio attacks are negated by the metal housing, which limits signals in and out. There are very few magnetic components in the device, limiting the possibility of using a very strong magnet to cause a forced unlock.

Lockpicking: Override lock 139 has a standard lock cylinder form factor and can have a wide variety of potential security features built in to increase pick resistance. Security pins, dimple keyways, tight tolerances, etc.

Drilling: Drilling resistance can be achieved by using hard or work-hardening materials in the construction of the device. The device currently does not have specific components for drilling resistance, but they may be added in the future, such as a thin sheet of hardened steel placed in front of the deadbolt.

Control System: The firearm lock uses a custom control board integrating a main microcontroller (MCU) with the biometric sensor, the various buttons and sensors, and the motor driver. The biometric sensor has its own control board and memory which handles fingerprint imaging and recognition. The MCU communicates with the biometric sensor to handle enrollment and recognition, with the two control systems communicating commands and results to each other. The fingerprint data is stored in nonvolatile memory and is retained through power loss. The database of fingerprints currently is stored on the biometric sensor's memory, but could also be stored in the main MCU's memory.

The current biometric sensor also has an RGB LED ring surrounding the sensor to provide feedback to the user. The main control board has a buzzer for additional feedback.

INDUSTRIAL APPLICATION

The present invention is applicable for individual firearm owner home use. It can also be applied to firearm range safety where the locks can be controlled by an authorized range safety representative.

What is claimed is:

1. A firearm lock for a firearm having a chamber, comprising:

a plunge having a retractable locking portion with shape corresponding to the firearm;

a plunge return spring coupled to the plunge;

a plunge interlock coupled to the plunge;

a chamber insert having a rear chamber lock, the chamber insert at least partially surrounding the plunge and the plunge return spring;

a deadbolt coupled to the plunge interlock;

an unlocking motor having a control board, the unlocking motor coupled to the deadbolt;

a biometric sensor coupled to the unlocking motor for detecting a physical characteristic of an authorized user;

a power supply for providing electrical power to the control board and the unlocking motor; and a housing coupled to the chamber insert, wherein the housing surrounds the control board, the power supply, and the unlocking motor.

2. The firearm lock of claim 1 wherein the firearm lock further includes:

a locked configuration with a portion of the plunge extending out from the chamber insert to prevent the portion of the plunge from being retracted into the chamber insert; and an unlocked configuration when an authorized physical characteristic of the authorized user is detected by the biometric sensor, and the electric power is applied to the unlocking motor from the power supply, the deadbolt is retracted to allow for movement of the plunge interlock and the plunge is retracted into the chamber insert.

3. The firearm lock of claim 2 wherein the chamber insert, the rear chamber lock, and the chamber plunge are placed through an ejection port of a firearm, and the chamber insert, the rear chamber lock, and the chamber plunge cannot be removed from the ejection port of the firearm when the firearm lock is in the locked configuration.

4. The firearm lock of claim 1 further comprising an override lock coupled to the plunge interlock wherein the override lock disengages the plunge interlock from the chamber plunge when the override lock is unlocked.

5. The firearm lock of claim 4 wherein the override lock is a combination lock.

6. The firearm lock of claim 1 further comprising a push pin coupled to the chamber plunge for manually extending the portion of the chamber plunge from the chamber insert to place the firearm lock in the locked configuration when the chamber insert is placed into an ejection port of a firearm.

7. The firearm lock of claim 1 further including:

a biometric processor coupled to the biometric sensor; and an electronic memory coupled to the biometric processor for storing biometric data for authorized users of the firearm lock;

wherein the control board compares the physical characteristic detected by the biometric sensor to the biometric data stored in the electronic memory to determine that the physical characteristic is the authorized physical characteristic of the authorized user.

8. The firearm lock of claim 7 wherein the biometric sensor is a fingerprint reader and the physical characteristic of the authorized user is a fingerprint.

9. The firearm lock of claim 7 wherein the biometric sensor is one of face, palm print, iris, voice, pulse features, and aggregated features.

10. The firearm lock of claim 1 further including a radio frequency tracking device coupled to the housing.

11. A firearm lock comprising:

a plunge having a retractable locking portion and a locking recess;

a chamber insert having a rear chamber lock, the chamber insert surrounding the plunge wherein the chamber insert, the rear chamber lock, and the plunge placed are placed through an ejection port of a firearm;

a plunge interlock coupled to the plunge;

a deadbolt coupled to the plunge interlock;

an unlocking motor having a motor gear to retract the deadbolt;

a power supply for providing electrical power to the unlocking motor;

a biometric sensor coupled to the unlocking motor for detecting a physical characteristic of the firearm user;

a housing coupled to the chamber insert, the housing surrounding a control board, the power supply, and the unlocking motor;

wherein the rear chamber lock, and the chamber plunge cannot be removed from the ejection port of the firearm when the firearm lock is in the locked configuration.

12. The firearm lock of claim 11 wherein the chamber insert, the rear chamber lock, and the chamber plunge are placed through an ejection port of a firearm and the chamber insert, the rear chamber lock, and the chamber plunge cannot be removed from the ejection port of the firearm when the firearm lock is in the locked configuration.

13. The firearm lock of claim 12 further comprising a control board coupled to the power supply, the biometric sensor, and the unlocking motor wherein the control board controls the unlocking motor by blocking electrical power from the unlocking motor when the firearm lock is locked and applying electrical power to the unlocking motor to retract the deadbolt from impeding the plunge interlock when the firearm lock is unlocked when an authorized physical characteristic of the authorized user is detected by the biometric sensor.

14. The firearm lock of claim 13 further comprising an override lock, wherein the override lock is unlocked to retract the plunge interlock from the chamber plunge.

15. The firearm lock of claim 11 further comprising a push pin coupled to the chamber plunge for manually extending the portion of the chamber plunge from the chamber insert to place the firearm lock in the locked configuration when the chamber insert is placed into an ejection port of a firearm.

16. The firearm lock of claim 11 further comprising:

a biometric processor coupled to the biometric sensor; and an electronic memory coupled to the biometric processor for storing biometric data for authorized users of the firearm lock;

wherein the control board compares the physical characteristic detected by the biometric sensor to the biometric data stored in the electronic memory to determine that the physical characteristic is the authorized physical characteristic of the authorized user.

17. The firearm lock of claim 11 wherein the biometric sensor is a fingerprint reader and the physical characteristic of the authorized user is a fingerprint.

18. The firearm lock of claim 11 further comprising a radio frequency tracking device within the housing.

* * * * *